US006122945A

United States Patent [19]

Grant

[11] Patent Number: 6,122,945

[45] Date of Patent: Sep. 26, 2000

[54] KEYLESS DOOR KNOB SECURITY DEVICE WITH STABILIZER ARM

[76] Inventor: Jackie N. Grant, 2021 Niles Ave. P.O. Box 2335, Brunswick, Ga. 31521

[21] Appl. No.: 09/247,981

[22] Filed: Feb. 11, 1999

[51] Int. Cl.[7] ..... E05B 13/02

[52] U.S. Cl. ..... 70/426; 70/DIG. 58; 70/428; 292/DIG. 2

[58] Field of Search ..... 292/DIG. 2, 423; 70/424, 425, 426, 427, 428, 455, DIG. 43, DIG. 56, DIG. 58

[56] References Cited

U.S. PATENT DOCUMENTS

| | | | |
|---|---|---|---|
| 1,000,962 | 8/1911 | Blais | 70/426 |
| 3,556,571 | 1/1971 | Laub, Jr. | 292/DIG. 2 |
| 3,761,119 | 9/1973 | Bennett et al. | 292/346 |
| 4,301,669 | 11/1981 | Floyd | 70/428 |
| 4,629,229 | 12/1986 | Correnti et al. | 292/DIG. 2 |
| 5,027,626 | 7/1991 | Appelbaum | 70/DIG. 58 |
| 5,609,049 | 3/1997 | Rundle et al. | 70/DIG. 58 |

*Primary Examiner*—Darnell M. Boucher

[57] ABSTRACT

A new keyless door knob security device with stabilizer arm for preventing access to a keyhole of a door knob to prevent unauthorized access. The inventive device includes a central shaft that has first and second ends and a longitudinal axis extending between the ends. A claw ring has a plurality of claws extending outwardly from it and an aperture through it. The central shaft extends through the aperture of the claw ring. The claws are adapted for grasping the door knob. A cover is slidably positionable along the central shaft such that sliding the cover in a first direction presses the claws towards each other such that the claws grasp the door knob. Sliding the cover in a second direction permits the claws to move apart from each other. A locking mechanism permits selective locking of the cover in a locked orientation and an unlocked orientation.

20 Claims, 2 Drawing Sheets

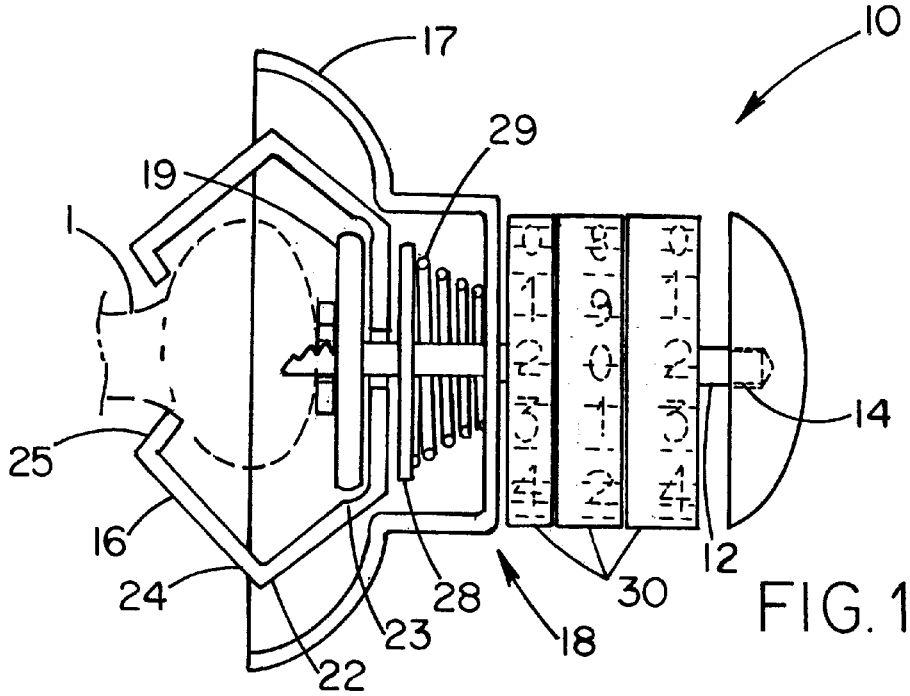
FIG. 1
FIG. 2
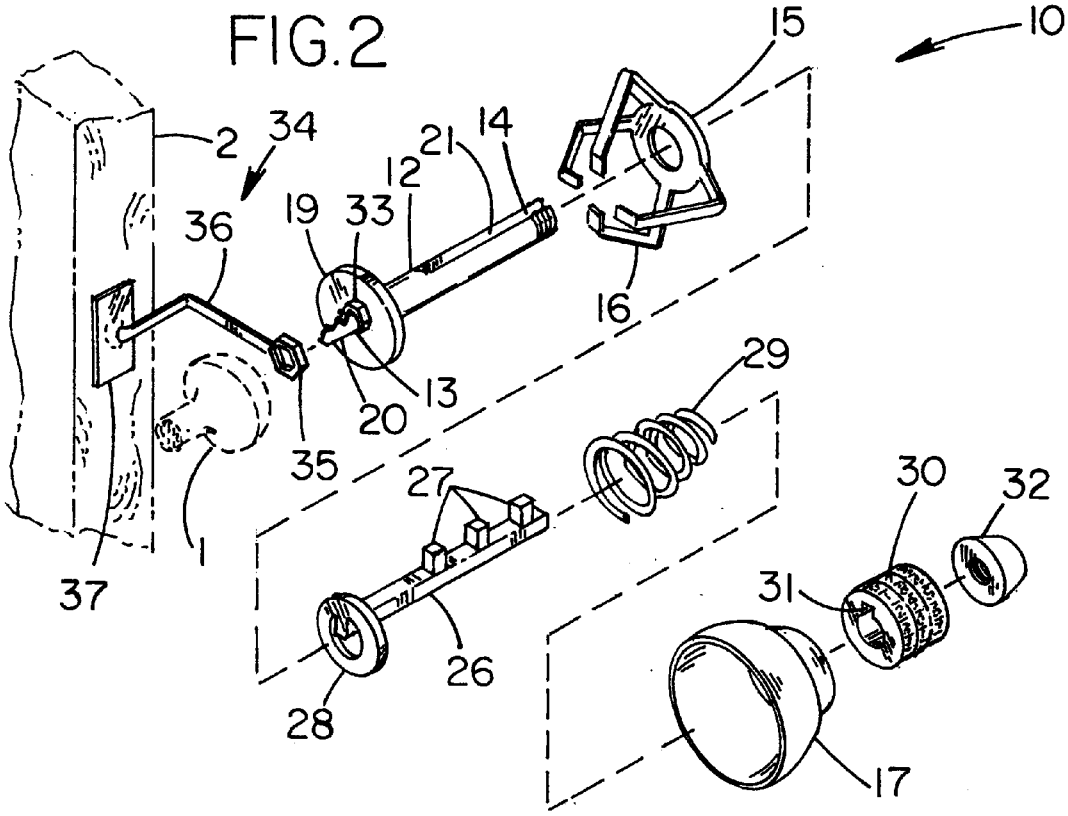

KEYLESS DOOR KNOB SECURITY DEVICE WITH STABILIZER ARM

BACKGROUND OF THE INVENTION

1. Field of the Invention

The present invention relates to door knob locking devices and more particularly pertains to a new keyless door knob security device with stabilizer arm for preventing access to a keyhole of a door knob to prevent unauthorized access.

2. Description of the Prior Art

The use of door knob locking devices is known in the prior art. More specifically, door knob locking devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,201,202; U.S. Pat. No. 4,226,104; U.S. Pat. No. Des. 200,599; U.S. Pat. No. 4,631,938; U.S. Pat. No. 3,206,955; PCT Patent No. WO 83/01641 (Inventor: Beards); and PCT Patent No. WO 80/00359 (Inventor: Eigemeier).

While these devices fulfill their respective, particular objectives and requirements, the aforementioned patents do not disclose a new keyless door knob security device with stabilizer arm. The inventive device includes a central shaft that has first and second ends and a longitudinal axis extending between the ends. A claw ring has a plurality of claws extending outwardly from it and an aperture through it. The central shaft extends through the aperture of the claw ring. The claws are adapted for grasping the door knob. A cover is slidably positionable along the central shaft such that sliding the cover in a first direction presses the claws towards each other such that the claws grasp the door knob. Sliding the cover in a second direction permits the claws to move apart from each other. A locking mechanism permits selective locking of the cover in a locked orientation and an unlocked orientation.

In these respects, the keyless door knob security device with stabilizer arm according to the present invention substantially departs from the conventional concepts and designs of the prior art, and in so doing provides an apparatus primarily developed for the purpose of preventing access to a keyhole of a door knob to prevent unauthorized access.

SUMMARY OF THE INVENTION

In view of the foregoing disadvantages inherent in the known types of door knob locking devices now present in the prior art, the present invention provides a new keyless door knob security device with stabilizer arm construction wherein the same can be utilized for preventing access to a keyhole of a door knob to prevent unauthorized access.

The general purpose of the present invention, which will be described subsequently in greater detail, is to provide a new keyless door knob security device with stabilizer arm apparatus and method which has many of the advantages of the door knob locking devices mentioned heretofore and many novel features that result in a new keyless door knob security device with stabilizer arm which is not anticipated, rendered obvious, suggested, or even implied by any of the prior art door knob locking devices, either alone or in any combination thereof.

To attain this, the present invention generally comprises a central shaft that has first and second ends and a longitudinal axis extending between the ends. A claw ring has a plurality of claws extending outwardly from it and an aperture through it. The central shaft extends through the aperture of the claw ring. The claws are adapted for grasping the door knob. A cover is slidably positionable along the central shaft such that sliding the cover in a first direction presses the claws towards each other such that the claws grasp the door knob. Sliding the cover in a second direction permits the claws to move apart from each other. A locking mechanism permits selective locking of the cover in a locked orientation and an unlocked orientation.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new keyless door knob security device with stabilizer arm apparatus and method which has many of the advantages of the door knob locking devices mentioned heretofore and many novel features that result in a new keyless door knob security device with stabilizer arm which is not anticipated, rendered obvious, suggested, or even implied by any of the prior art door knob locking devices, either alone or in any combination thereof.

It is another object of the present invention to provide a new keyless door knob security device with stabilizer arm which may be easily and efficiently manufactured and marketed.

It is a further object of the present invention to provide a new keyless door knob security device with stabilizer arm which is of a durable and reliable construction.

An even further object of the present invention is to provide a new keyless door knob security device with stabilizer arm which is susceptible of a low cost of manufacture with regard to both materials and labor, and which accordingly is then susceptible of low prices of sale to the consuming public, thereby making such keyless door knob security device with stabilizer arm economically available to the buying public.

Still yet another object of the present invention is to provide a new keyless door knob security device with stabilizer arm which provides in the apparatuses and methods of the prior art some of the advantages thereof, while simultaneously overcoming some of the disadvantages normally associated therewith.

Still another object of the present invention is to provide a new keyless door knob security device with stabilizer arm for preventing access to a keyhole of a door knob to prevent unauthorized access.

Yet another object of the present invention is to provide a new keyless door knob security device with stabilizer arm which includes a central shaft that has first and second ends and a longitudinal axis extending between the ends. A claw ring has a plurality of claws extending outwardly from it and an aperture through it. The central shaft extends through the aperture of the claw ring. The claws are adapted for grasping the door knob. A cover is slidably positionable along the central shaft such that sliding the cover in a first direction presses the claws towards each other such that the claws grasp the door knob. Sliding the cover in a second direction permits the claws to move apart from each other. A locking mechanism permits selective locking of the cover in a locked orientation and an unlocked orientation.

Still yet another object of the present invention is to provide a new keyless door knob security device with stabilizer arm that provides a temporary means of securing an entrance other than replacing a broken lock.

Even still another object of the present invention is to provide a new keyless door knob security device with stabilizer arm that prevents landlords, ex-roommates, etc. from using their keys to enter a premises.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a schematic partial cross-sectional view of a new keyless door knob security device with stabilizer arm according to the present invention.

FIG. 2 is a schematic exploded view of the present invention.

DESCRIPTION OF THE PREFERRED EMBODIMENT

Figure 3:
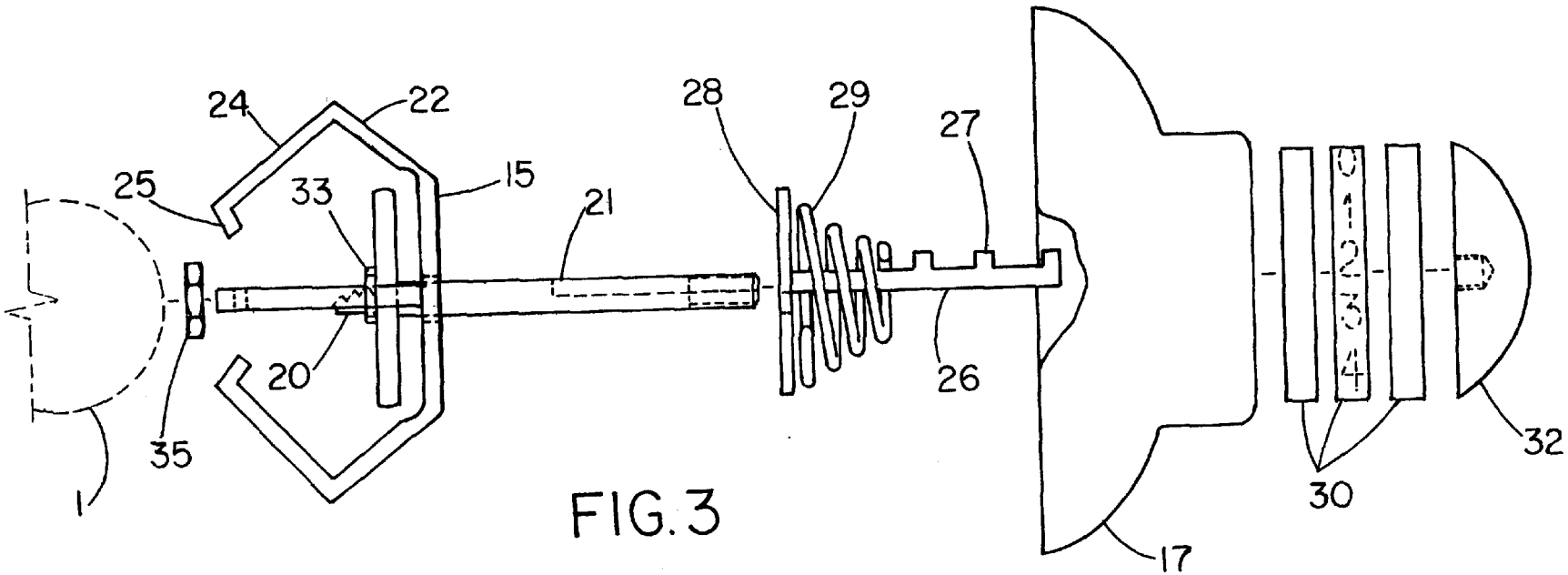
FIG. 3 is a schematic exploded view of the present invention.
Figure 4:
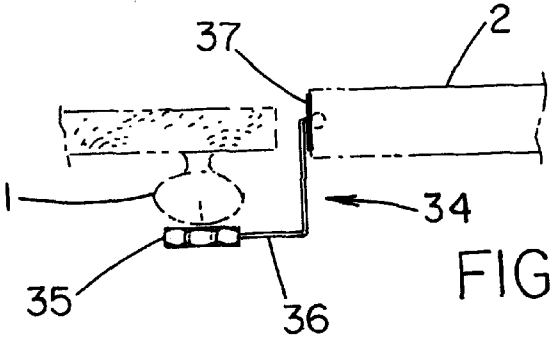
FIG. 4 is a schematic side view of the present invention.

With reference now to the drawings, and in particular to FIGS. 1 through 4 thereof, a new keyless door knob security device with stabilizer arm embodying the principles and concepts of the present invention and generally designated by the reference numeral 10 will be described.

As best illustrated in FIGS. 1 through 4, the keyless door knob security device with stabilizer arm 10 comprises a central shaft 12 that has first and second ends 13,14 and a longitudinal axis extending between the ends. A claw ring 15 has a plurality of claws 16 extending outwardly from it and an aperture through it. The central shaft extends through the aperture of the claw ring. The claws are adapted for grasping a door knob 1. A cover 17 is slidably positionable along the central shaft such that sliding the cover in a first direction presses the claws towards each other such that the claws grasp the door knob. Sliding the cover in a second direction permits the claws to move apart from each other. The cover should also cover the claws to prevent insertion of prying devices under the claws. A locking mechanism 18 permits selective locking of the cover in a locked orientation and an unlocked orientation.

In more detail, it is seen that the first end of the central shaft preferably has an annular flange 19 outwardly extending therefrom generally perpendicularly to the longitudinal axis of the central shaft.

Also preferably, the first end of the central shaft has a dummy key 20 extending outwardly therefrom generally along the longitudinal axis of the central shaft. The dummy key is slidably insertable in a keyhole of a door knob. The dummy key helps prevent rotation of the door knob in conjunction with a stabilizer bar, as will be discussed more fully below.

Preferably, the central shaft has a groove 21 extending therein from its second end towards its first end. Optionally, the second end of the central shaft is threaded.

A claw ring has a plurality of claws extending outwardly from it and an aperture therethrough. The central shaft is slidably inserted in the aperture of the claw ring such that the claw ring is positioned adjacent the annular flange of the central shaft between the annular flange and the second end of the central shaft. The claws are adapted for grasping the door knob between the claws and the claw ring.

Preferably, each of the claws has a first portion 22 that is pivotally coupled to the claw ring (such as by having a resiliently deformable portion 23), a second portion 24 angling inward of the first portion at an obtuse angle and toward the door knob, and a third portion 25 angling inward of the second portion at an obtuse angle and back toward the central shaft.

The locking mechanism includes an elongate toothed rod 26 that is slidably inserted in the groove of the central shaft. The toothed rod has a plurality of teeth 27 extending from it away from the central shaft. Preferably, the toothed rod is coupled to an inner edge of a spring retaining ring 28. The central shaft slidably extends through the spring retaining ring.

A spring 29 extends around the central shaft and is positioned between the spring retaining ring and the cover to bias the cover away from the claws, thereby biasing the first end of the central shaft away from the locking rings.

A plurality of annular locking rings 30 are rotatably disposed around the central shaft and the toothed rod. Each of the locking rings has at least one notch 31 extending inwardly from a central aperture thereof. The notches are dimensioned to permit passage of the teeth of the toothed rod through them when the teeth and notches are aligned. The central shaft is slidably positionable along the locking rings when the notches of the locking rings are aligned with the teeth of the toothed rod. Preferably, each of the rings has number indicia positioned along its outer perimeter.

Preferably, the locking rings are rotatably coupled together such as by a tongue and groove assembly (not shown). Ideally, the locking rings are also rotatably coupled to the cover so that the rings are pulled along with the cover when the cover is pushed towards the door knob. The cover can be pushed towards the door knob to permit locking of the locking rings.

Alternative locking mechanisms include a keyed lock of a type known in the art (not shown).

An end cap 32 is coupled to the second end of the central shaft. The end cap may be threadedly coupled to the central shaft, or may be fixedly coupled to it such that it cannot be removed.

Preferably, the central shaft has a polygonal ring 33 extending around the base of the dummy key and positioned adjacent the annular flange of the central shaft. A stabilizer 34 limits rotation of the door knob and the lock adapter, especially when left unlocked.

The stabilizer has a first ring 35 removably and nonrotatably engaging an outer edge of the polygonal ring of the central shaft. The stabilizer has an arm portion 36 that may or may not be angled, depending on the use, extending from the first ring. The stabilizer has a mounting portion 37 is mounted to a structure 2 such as a door or door frame, the arm portion is pivotably coupled to the mounting portion.

The preferred length of the central shaft along its longitudinal axis is about 2¼ inches. The preferred dimensions of each of the claws is about 2 inches long by about ½ inch wide. The preferred outer diameter of the locking rings and cover is about 1½ inches.

In use, the mounting portion of the stabilizer (if used) is coupled to a structure. The first ring of the stabilizer is placed over the polygonal ring of the central shaft. The dummy key is inserted in the lock hole of a door knob. The housing is pushed forward to clamp the claws down around the door knob. Holding the housing forward, the locking rings are rotated to jumble the combination.

To remove the invention, the locking rings are rotated to a predetermined combination of the numbered indicia which corresponds to having the notches of the locking rings aligned with the teeth of the toothed rod. When the correct combination is set, the spring pushes the housing and locking rings back, permitting the claws to move apart and thereby permitting removal of the security device.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A keyless door knob security device for mounting to a doorknob, comprising:

a central shaft having first and second ends and a longitudinal axis extending between said ends;

a claw ring having a plurality of claws extending outwardly therefrom and an aperture therethrough, said central shaft extending through said aperture of said claw ring said claws being adapted for grasping said door knob;

a cover being slidably positionable along said central shaft such that sliding said cover in a first direction presses said claws towards each other such that said claws grasp said door knob and sliding said cover in a second direction permits said claws to move apart from each other;

a locking mechanism for selectively locking said cover in a locked orientation and an unlocked orientation; and a dummy key extending outwardly in a direction generally parallel to said longitudinal axis of said central shaft, said dummy key being slidably insertable in a keyhole of a door knob.

2. The security device of claim 1, wherein said first end of said central shaft comprises said dummy key.

3. The security device of claim 1, wherein said first end of said central shaft has an annular flange outwardly extending therefrom generally perpendicularly to said longitudinal axis of said central shaft, said claw ring being positioned adjacent said annular flange.

4. The security device of claim 1, wherein each of said claws has a first portion being pivotally coupled to said claw ring, a second portion angling inward of said first portion, and a third portion angling inward of said second portion.

5. The security device of claim 1, wherein said locking mechanism includes a toothed rod being coupled to said central shaft, said toothed rod having a plurality of teeth extending therefrom, a plurality of annular locking rings being rotatably disposed around said central shaft and said toothed rod, each of said locking rings having at least one notch extending inwardly from a central aperture thereof, said notches being dimensioned for permitting passage of said teeth of said toothed rod therethrough, said central shaft being slidably positionable along said locking rings when said notches of said locking rings are aligned with said teeth of said toothed rod.

6. The security device of claim 1, further comprising a spring extending around said central shaft and being positioned between said clawed ring and said cover, said spring biasing said cover away from said claws.

7. The security device of claim 5, wherein said toothed rod is coupled to an inner edge of a spring retaining ring, said central shaft extending through said spring retaining ring.

8. The security device of claim 5, wherein said locking rings are rotatably coupled together.

9. The security device of claim 8, wherein said locking rings are rotatably coupled to said cover.

10. The security device of claim 1, further comprising a stabilizer for limiting rotation of said door knob, wherein said central shaft has a polygonal ring extending around said first end thereof, said stabilizer having a first ring removably and nonrotatably engaging said polygonal ring of said central shaft, said stabilizer having an arm portion extending from said first ring and adapted for mounting to a structure.

11. The security device of claim 10, wherein said stabilizer has a mounting portion being mounted to said structure, said arm portion being coupled to said mounting portion.

12. The security device of claim 11, wherein said arm portion is pivotably coupled to said mounting portion.

13. A keyless door knob security device for mounting to a doorknob, comprising:

a central shaft having first and second ends and a longitudinal axis extending between said ends;

said first end of said central shaft having an annular flange outwardly extending therefrom generally perpendicularly to said longitudinal axis of said central shaft;

said first end of said central shaft having a dummy key extending outwardly therefrom generally along said longitudinal axis of said central shaft, said dummy key being slidably insertable in a keyhole of a door knob;

said central shaft having a groove extending therein from said second end towards said first end thereof;

a claw ring having a plurality of claws extending outwardly therefrom and an aperture therethrough, said central shaft being slidably inserted in said aperture of said claw ring such that said claw ring is positioned adjacent said annular flange of said central shaft between said annular flange and said second end of said central shaft;

said claws being adapted for grasping said door knob between said claws and said claw ring;

each of said claws having a first portion being pivotally coupled to said claw ring, a second portion angling inward of said first portion, and a third portion angling inward of said second portion;

a cover being slidably positionable along said central shaft such that sliding said cover in a first direction presses said claws towards each other such that said claws grasp said door knob and sliding said cover in a second direction permits said claws to move apart from each other;

an elongate toothed rod being slidably inserted in said groove of said central shaft, said toothed rod having a plurality of teeth extending therefrom;

said toothed rod being coupled to an inner edge of a spring retaining ring, said central shaft slidably extending through said spring retaining ring;

a spring extending around said central shaft and being positioned between said spring retaining ring and said cover, said spring biasing said cover away from said claws thereby biasing said first end of said central shaft away from said locking rings;

a plurality of annular locking rings being rotatably disposed around said central shaft and said toothed rod, each of said locking rings having at least one notch extending inwardly from a central aperture thereof, said notches being dimensioned for permitting passage of said teeth of said toothed rod therethrough;

said central shaft being slidably positionable along said toothed rod when said notches of said locking rings are aligned with said teeth of said toothed rod;

each of said rings having number indicia positioned along an outer perimeter thereof;

said locking rings being rotatably coupled together;

said locking rings being rotatably coupled to said cover;

an end cap being coupled to said second end of said central shaft;

said central shaft having a polygonal ring extending around said dummy key and positioned adjacent said annular flange of said central shaft;

a stabilizer for limiting rotation of said door knob;

said stabilizer having a first ring removably and nonrotatably engaging said polygonal ring of said central shaft;

said stabilizer having an arm portion extending from said first ring; and said stabilizer having a mounting portion being mounted to a structure, said arm portion being pivotably coupled to said mounting portion.

14. A keyless door knob security device for mounting to a doorknob, comprising:

a central shaft having first and second ends and a longitudinal axis extending between said ends;

a claw ring having a plurality of claws extending outwardly therefrom and an aperture therethrough, said central shaft extending through said aperture of said claw ring said claws being adapted for grasping said door knob;

a cover being slidably positionable along said central shaft such that sliding said cover in a first direction presses said claws towards each other such that said claws grasp said door knob and sliding said cover in a second direction permits said claws to move apart from each other; and a locking mechanism for selectively locking said cover in a locked orientation and an unlocked orientation;

wherein said locking mechanism includes a toothed rod being coupled to said central shaft, said toothed rod having a plurality of teeth extending therefrom, a plurality of annular locking rings being rotatably disposed around said central shaft and said toothed rod, each of said locking rings having at least one notch extending inwardly from a central aperture thereof, said notches being dimensioned for permitting passage of said teeth of said toothed rod therethrough, said central shaft being slidably positionable along said locking rings when said notches of said locking rings are aligned with said teeth of said toothed rod.

15. The security device of claim 14, wherein said toothed rod is coupled to an inner edge of a spring retaining ring, said central shaft extending through said spring retaining ring.

16. The security device of claim 14, wherein said locking rings are rotatably coupled together.

17. The security device of claim 16, wherein said locking rings are rotatably coupled to said cover.

18. The security device of claim 14, wherein said first end of said central shaft has a dummy key extending outwardly therefrom generally along said longitudinal axis of said central shaft, said dummy key being slidably insertable in a keyhole of a door knob.

19. The security device of claim 14, further comprising a stabilizer for limiting rotation of said door knob, wherein said central shaft has a polygonal ring extending around said first end thereof, said stabilizer having a first ring removably and nonrotatably engaging said polygonal ring of said central shaft, said stabilizer having an arm portion extending from said first ring and adapted for mounting to a structure.

20. The security device of claim 19, wherein said stabilizer has a mounting portion being mounted to said structure, said arm portion being coupled to said mounting portion, and wherein said arm portion is pivotably coupled to said mounting portion.

* * * * *